United States Patent [19]

Wehling

[11] 3,958,403

[45] May 25, 1976

[54] OPEN-END SPINNING UNIT WITH FIBER GUIDE DISC

[75] Inventor: Rolf Wehling, Bremen, Germany

[73] Assignee: Fried. Krupp Gesellschaft mit beschrankter Haftung, Essen, Germany

[22] Filed: Apr. 25, 1975

[21] Appl. No.: 571,629

[30] Foreign Application Priority Data

May 3, 1974 Germany ..... 2421415

[52] U.S. Cl. ..... 57/58.89

[51] Int. Cl.[2] ..... D01H 1/12

[58] Field of Search ..... 57/1, 34 R, 58.89–58.95

[56] References Cited

UNITED STATES PATENTS

| | | | |
|---|---|---|---|
| 3,328,949 | 7/1967 | Pavek et al. | 57/58.89 |
| 3,339,359 | 9/1967 | Ripka et al. | 57/58.89 |
| 3,624,994 | 12/1971 | Rohlena et al. | 57/58.95 X |
| 3,778,989 | 12/1973 | Schon | 57/58.89 |
| 3,780,513 | 12/1973 | Watanabe et al. | 57/58.89 X |

*Primary Examiner*—Donald E. Watkins

*Attorney, Agent, or Firm*—Spencer & Kaye

[57] ABSTRACT

In an open-end spinning unit for producing yarn from fiber material, the unit including a spinning rotor having a circumferential portion extending axially from one axial end face of the rotor to enclose a space in which such yarn is formed and which defines a fiber collection trough, and a fiber guide disc rotatably mounted coaxially of the rotor and having at least a portion disposed within such space, the guide disc is free of physical connection to any drive system and is mounted to be freely rotatable, and the unit further includes a force transmitting arrangement operatively connected between the rotor and the disc for causing the rotation of the rotor to induce rotation of the disc without physical contact between the rotor and the disc.

10 Claims, 6 Drawing Figures

OPEN-END SPINNING UNIT WITH FIBER GUIDE DISC

BACKGROUND OF THE INVENTION

The present invention relates to an open-end spinning unit of the type including a fiber guide disc arranged so that at least its largest diameter section extends into the opening of the spinning rotor.

Open-end spinning units with stationary fiber guide discs are disclosed in German Auslegeschrift [Published Patent Application] No. 1,111,549. In the arrangement disclosed therein, the fiber guide disc is arranged with respect to the spinning rotor so that a narrow space remains between the surface of the fiber guide disc and the inner bottom surface of the rotor. The yarn formed in the fiber collecting trough is guided through this space. Consequently, the fiber guide disc serves the purpose of providing sufficient separation between the fibers entering the fiber collecting trough and the yarn removed therefrom.

The drawback of the known arrangement is that the stationary fiber guide disc substantially influences the movement of air in the spinning rotor and leads to turbulences and eddies in the region of the fiber collecting trough. The essential cause of this interference with the spinning process is the substantial difference in speed between the fiber guide disc and the fiber collection trough of the spinning rotor which rotates at high speed.

In order to remove the above-described drawbacks, an open-end spinning unit has been developed which has a break-up roller arranged coaxially with the spinning rotor and in which the break-up roller is provided with a fiber guide edge at its portion facing the spinning rotor. The fiber guide edge together with the associated housing edge forms a substantially radial annular gap through which the break-up roller brings separated fibers to the spinning rotor. Such an arrangement is disclosed in German Offenlegungsschrift (Laid-Open Application No. 2,064,697.

The drawback of this known open-end spinning unit is that the speed of the fiber guide disc is not independent of the speed of the break-up roller since the latter, in view of conditions in its combing range, cannot rotate at any desired high speed. In this case there consequently likewise exists a relatively great difference in speed between the associated housing edge and the spinning rotor.

SUMMARY OF THE INVENTION

It is an object of the present invention to provide an open-end spinning unit with a fiber guide disc in which — independently of whether the break-up roller is arranged coaxially or offset with respect to the spinning rotor — more favorable spinning conditions exist in the region of the intake section of the spinning rotor as well as in the region of the fiber collecting trough.

This and other objects according to the invention are accomplished by constructing the fiber guide disc as an independent, rotatably mounted unit which is driven without contact by one of the rotating components of the spinning unit which lie opposite thereto, i.e., the spinning rotor or the break-up roller.

In order to produce the most favorable spinning conditions it is advisable to make variable the drive energy which is transmitted to the fiber guide disc.

Depending on the configuration of the open-end spinning unit, the fiber guide disc may be driven indirectly by the break-up roller or by the spinning rotor. If the break-up roller is mounted in a manner such that it is axially offset with respect to the spinning rotor, as disclosed in German Published patent application No. 1,111,549, the fiber guide disc can be driven only via the spinning rotor unless additional expenditures are made.

With a coaxial arrangement of the break-up roller and the spinning rotor, the fiber guide disc is advisably also driven via the spinning rotor since, as already mentioned above, the peripheral speed of the break-up roller is substantially lower than that of the spinning rotor.

In a spinning unit with a break-up roller arranged eccentrically with respect to the spinning rotor, the fiber guide disc, which is coaxial with the spinning rotor, is advisably directly mounted in the housing of the break-up roller; in spinning units where the break-up roller is coaxial with the spinning rotor, the fiber guide disc is mounted in the break-up roller itself.

In a particularly simple embodiment of the present invention, the fiber guide disc is provided with take-up, or fluid coupling, vanes and is driven by the circulation of air produced by the spinning rotor. The take-up vanes are here advisably arranged in an area of the frontal face of the fiber guide disc where a return action on the flow conditions in the fiber collecting trough can possibly occur only to a very slight degree or not at all. If necessary, the spinning rotor may also be provided with take-up vanes at its bottom surface.

In another preferred embodiment of the invention, one of the oppositely disposed surfaces of the spinning rotor and of the fiber collecting trough is provided with axially polarized annular magnets and the associated countersurface is made of electrically conductive material at least in the region of the annular magnets.

Due to the relative movement of the annular magnet with respect to the electrically conductive countersurfaces, eddy currents are produced therein, creating a force which carries along the fiber guide disc which is mounted without being provided with its own drive means. Advisably, the ring magnet is here disposed in the fiber guide disc since the centrifugal forces associated with the spinning rotor would give rise to structural difficulties.

The forces present between the spinning rotor and the fiber guide disc, and thus the range of speeds of the fiber guide disc, can be varied within certain limits by providing for adjustment of the distance between the bottom surface of the spinning rotor and the frontal face of the fiber guide disc.

In a further embodiment of the present invention, the rear surface of the fiber guide disc which faces away from the spinning rotor is disposed opposite a multipole, axially polarized annular magnet which is disposed in a component separate from the fiber guide disc, the fiber guide disc being made of electrically conductive material at least in the area of this "second magnet".

By means of the second magnet, which with a break-up roller arranged coaxially with respect to the spinning rotor may be disposed in the break-up roller, the speed of the fiber guide disc may be set within a range which is limited by the speed of the spinning rotor and that of the break-up roller.

In an arrangement where the break-up roller is offset with respect to the spinning rotor, the second magnet is advisably arranged to be at least radially stationary and is an electromagnet producing a variable field intensity. In this case the speed of the fiber guide disc can be varied over a wide range and the supply of current to the second magnet will not produce any difficulties.

An open-end spinning unit is conceivable in which the second magnet is disposed on the surface of the break-up roller facing the rear surface of the fiber guide disc, the break-up roller being arranged coaxially with the fiber guide disc.

This embodiment thus has a dual indirect drive in that the spinning rotor drives the fiber guide disc and the fiber guide disc drives the break-up roller.

The spinning unit provided with the second magnet may be further modified to provide for adjustment of the distance between the rear surface of the fiber guide disc and the second magnet.

DESCRIPTION OF THE PREFERRED EMBODIMENT

Figure 1:
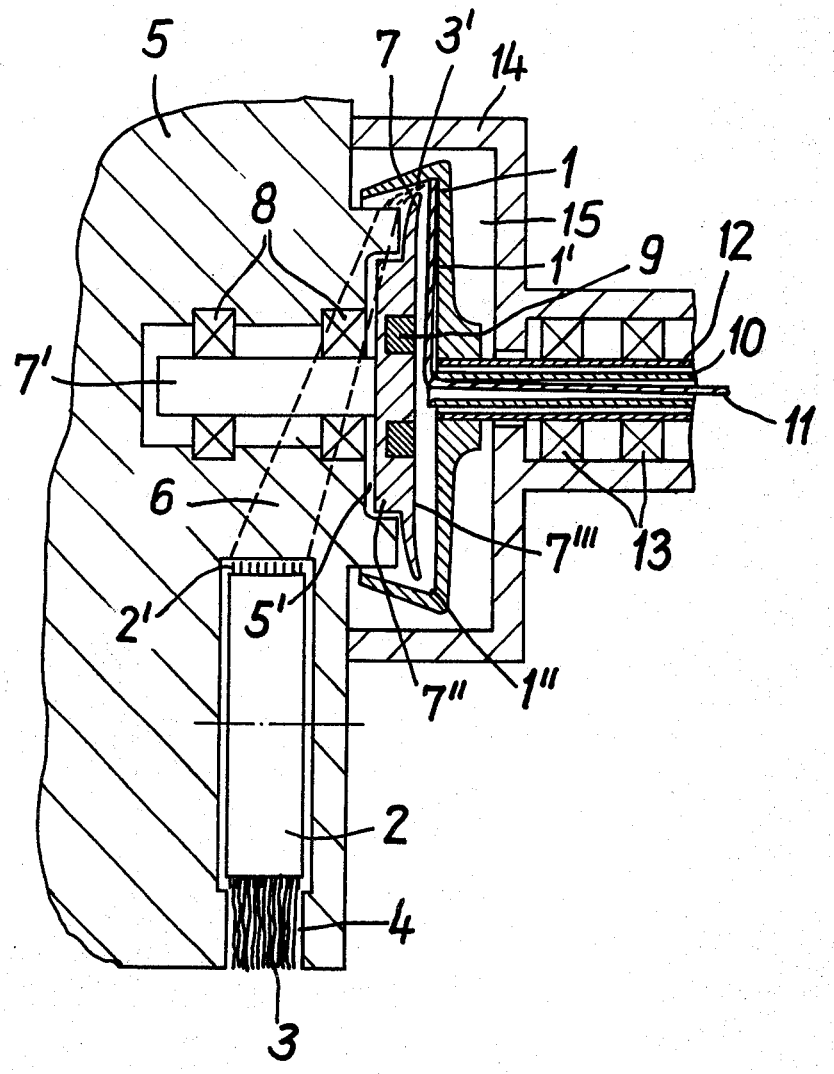
FIG. 1 is a cross sectional view of an open-end spinning unit according to the invention with a break-up roller offset with respect to the spinning rotor and a fiber guide disc which is driven by magnetic forces.

The open-end spinning unit illustrated in FIG. 1 is provided with a break-up roller 2 which is axially offset with respect to the spinning rotor 1 and is driven in a known manner, for example by means of a tangential belt (not shown). Fiber material 3 to be processed is fed to the break-up roller 2 through an inlet channel 4, is broken up by the break-up roller, which is provided with a known combing arrangement 2', and is guided to the spinning rotor 1 through a fiber guide channel 6 in housing 5. The bottom surface 1' of the spinning rotor 1 is disposed opposite a fiber guide disc 7 which is supported in housing 5 by means of its shaft 7' through the intermediary of bearings 8. The rear section 7'' of the fiber guide disc 7 is a defined section which engages into a correspondingly shaped circular recess 5' of housing 5.

In the region of its largest diameter, the fiber guide disc 7 is curved in the direction toward the bottom surface 1' as well as in the direction toward fiber collecting trough 1'' of spinning rotor 1. The fiber guide disc 7 may, however, also be shaped differently.

The rotor 1 is made of electrically conductive material and the fiber guide disc 7 is provided on its frontal face 7''', which is directed toward the bottom surface 1' of the spinning rotor 1, with a multipole annular magnet 9 which produces eddy currents in the region of rotor 1 adjacent bottom surface 1', the eddy currents resulting in a force that causes rotation of the fiber guide disc 7.

The distance between the surfaces 1' and 7''' and the field intensity of the annular magnet 9 are advisably selected so that the rate of rotation of the fiber guide disc 7 is about 50 to 90% of the rate of rotation of the rotor 1. These relationships — i.e. the presence of an almost identical peripheral speed in the area of the outer section of the fiber guide disc and of the spinning rotor — result in the practically complete absence of air turbulence in the area of the fiber collecting trough 1''.

The fibers 3' which have been broken up by break-up roller 2 are collected in the fiber collection trough 1'' and are removed from there, for example by means of a pair of extraction rollers (not shown), through a stationary yarn extraction tube 10 as the finished yarn 11.

The yarn extraction tube 10 is disposed in the bore of shaft 12 of the spinning rotor 1; its inner end protrudes slightly beyond the bottom surface 1' of the spinning rotor.

The spinning rotor 1 is mounted via bearings 13 in a rotor housing 14 which is tightly connected with housing 5 and the interior of which is kept at a pressure below atmospheric by means of known suction devices.

The open-end spinning unit shown in FIG. 1 may also, without departing from the spirit of the invention, be designed so that the annular magnet 9 is disposed in the bottom surface 1' of the spinning rotor 1 and the frontal face 7''' of the fiber guide disc 7 is made of electrically conductive material at least in the area opposite the annular magnet.

The use of an indirect drive for the fiber guide disc 7 is not limited to open-end spinning units where the break-up roller 2 is eccentric to the spinning rotor.

Figure 2:
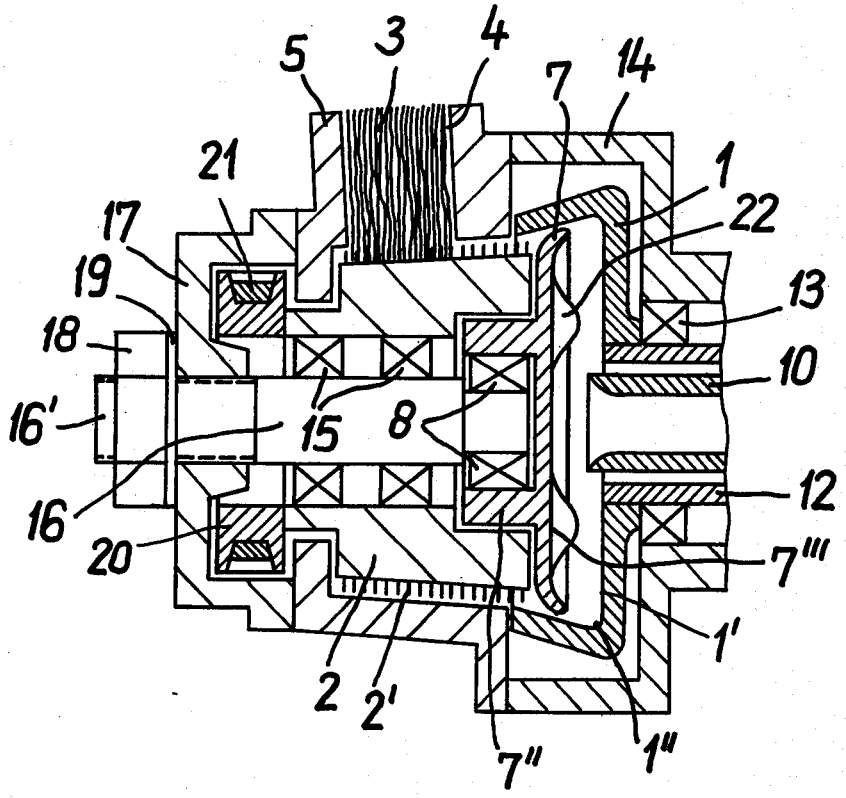
FIG. 2 is a view similar to that of FIG. 1 of an open-end spinning unit according to the invention with a break-up roller arranged coaxially with the spinning rotor and a fiber guide disc with take-up vanes.

FIG. 2 shows an open-end spinning unit in which the fiber guide disc 7 as well as the break-up roller 2 are coaxial with the spinning rotor 1.

The fiber guide disc 7 and the break-up roller 2 are here supported, via bearings 8 and 15, respectively, on a journal 16 which is held by means of a threaded section 16' in the threaded bore of a housing 17. The threaded journal 16 may be axially displaced by turning it; its position with respect to housing 17 is secured by a nut 18 and a spring disc 19 resting against housing 17.

*) and in consequence for adjustment also the fiber guide disc 7 with respect to spinning rotor 1

The outwardly directed end of the break-up roller 2 is bolted or otherwise fixed to a belt pulley 20, into which engages, for example, a belt 21 which also passes around a suitable drive member (not shown).

The fiber guide disc 7 is provided on its frontal face 7''' with take-up, or fluid coupling, vanes 22 which are acted on by the air stream produced by the spinning rotor 1 to cause rotation of the fiber guide disc. This aerodynamic drive can be designed so that the fiber guide disc has practically the same rate of rotation as the spinning rotor driving it, which may also be provided with take-up vanes if required.

In the open-end spinning unit shown in FIG. 3 the fiber guide disc 7 is driven by the spinning rotor 1, in the manner described with reference to FIG. 1, by magnetic forces produced by an axially polarized annular magnet 9. The rear section 7'' of the fiber guide disc is here designed as a defined section which engages into a circular recess 2'' of the break-up roller 2 which is also coaxial with the spinning rotor 1.

A multipole annular magnet 23 is disposed in the frontal face of roller 2 defining recess 2'' and facing the fiber guide disc and this magnet acts on the rear surface of section 7'' opposite such frontal face and spaced at a distance therefrom. The portion of section 7'' at the rear surface is made of electrically conductive material at least in the region adjacent the annular magnet 9.

Due to the electromagnetic interaction produced between parts 7 and 2 by the annular magnet 23, the break-up roller, which is supported on shaft 24 through the intermediary of bearings 15 and has no drive of its own, is driven by the fiber guide disc 7 which itself is driven indirectly; thus the break-up roller also requires no drive of its own. Between the fiber guide disc and the break-up roller as well as between the fiber guide disc and the spinning rotor there exists a difference in the rate of rotation, so that the rate of rotation of the fiber guide disc 7 lies between that of the break-up roller 2 and that of the spinning rotor 1.

Figure 3:
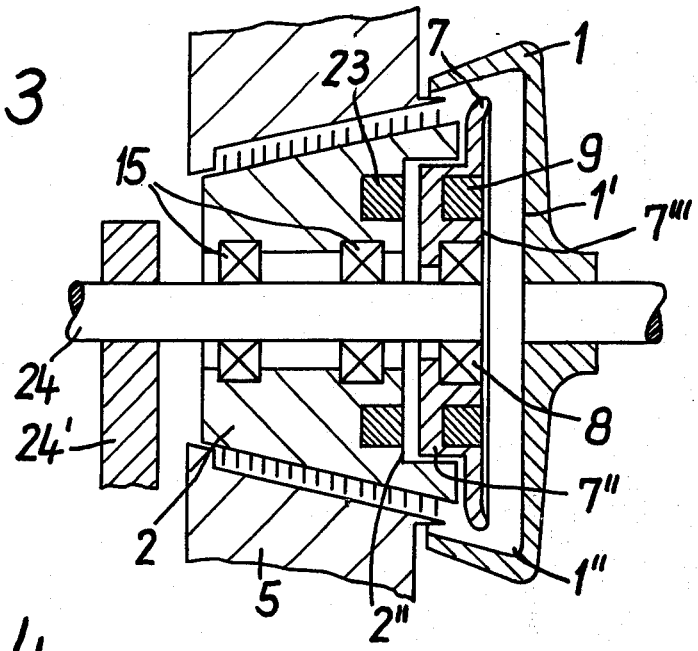
FIG. 3 is a view similar to that of FIG. 1 of an open-end spinning unit according to the invention with a break-up roller arranged coaxially with the spinning rotor and a fiber guide disc arranged therebetween and driven by magnetic forces from the spinning rotor, the rear surface of the fiber guide disc which faces away from the spinning rotor being disposed at a distance from and opposite an annular second magnet provided in the break-up roller.

In contrast to the previously described embodiments, in the embodiment of FIG. 3, the shaft 24 is stationarily connected with the housing 5 of the break-up roller via supports 24'; it may be provided with a bore through which the yarn formed in the area of the fiber collection trough 1'' from the incoming fiber material is removed.

The open-end spinning unit shown schematically in FIG. 3 may be modified in such a manner that the break-up roller 2 which is provided with an annular magnet 23 is connected with its own drive unit, for example via a drive belt, so that its rotational speed can be independently controlled. Since the rotational speed of the break-up roller normally lies below that of the spinning rotor, the movement of the indirectly driven fiber guide disc is more or less inhibited by its interaction with the break-up roller. Varying the distance between the annular magnet 23 and the electrically conductive rear surface of the fiber guide disc 7 disposed opposite thereto or varying the field intensity of the annular magnet thus makes it possible to increase or decrease the rotational speed of the fiber guide disc, while the speed of roller 2 is maintained constant by its own drive unit.

In open-end spinning units where the break-up rollers 2 are disposed eccentrically to the spinning rotor 1, as in the case of the embodiment of FIG. 1, the rotational speed of the indirectly driven fiber guide disc 7 may be influenced by disposing its rearward section 7'' opposite a radially stationary annular magnet; advisably, the annular magnet in this embodiment is not a permanent magnet but a multipole electromagnet where the magnetic field intensity can be influenced by varying the magnetization current in the magnetic windings. The supply of electrical energy produces no difficulties due to the stationary arrangement of the electromagnet, for example in the housing 5 of the break-up roller. The speed of the fiber guide disc can be varied over a continuous range or set between a maximum rate of revolution and zero.

Figure 4:
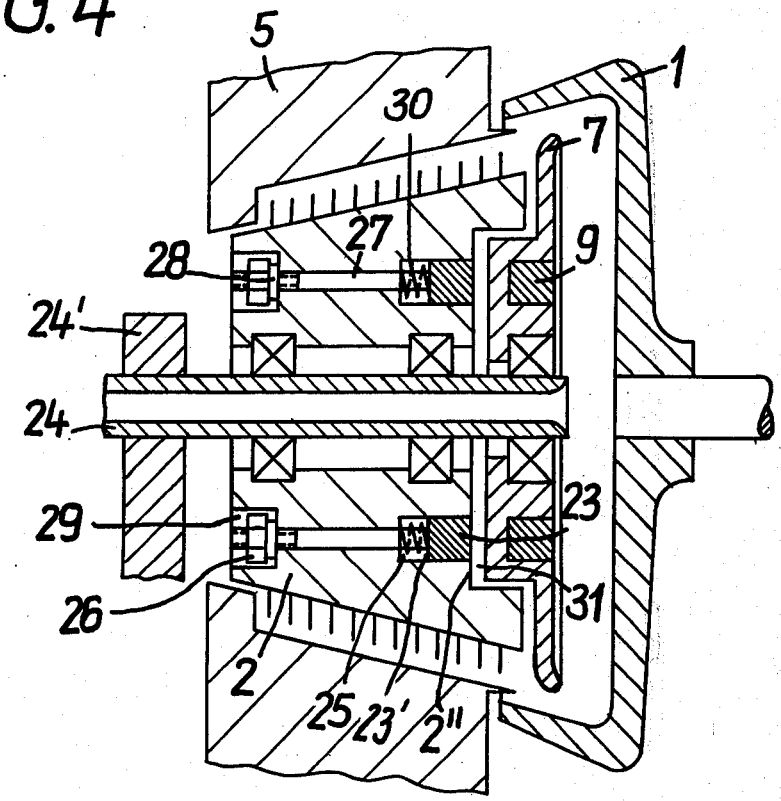
FIG. 4 is a view similar to that of FIG. 1 of an open-end spinning unit similar to that of FIG. 3, but with an axially displaceable second magnet.

In the open-end spinning unit of FIG. 4 the break-up roller 2 is also provided with a multipole permanent magnet 23 in the region of its frontal face 2'' which is disposed opposite fiber guide disc 7.

The annular permanent magnet is here guided for axial movement in an annular recess 25 in break-up roller 2. The adjustment of the annular magnet is effected by rotating adjustment nuts 26 which are in engagement with adjustment rods 27 fastened to the rear surface 23' of the annular magnet 23.

The nuts 26 are supported by break-up roller 2, in recesses 29, by means of washers 28, and the axial position of the annular magnet 23 is set by rotating nuts 26 so as to move rods 27 axially against the force of prestressed compression spring elements 30 each interposed between the annular magnet 23 and the base of the annular recess 25.

By displacing the annular magnet 23 axially, the size of the air gap 31 between parts 23 and 7, and thus the driving force exerted by the fiber guide disc on the break-up roller, can be varied.

The embodiment shown in FIG. 4 thus permits adaptation of the mode of operation of the break-up roller to various fiber materials or the setting of the rate of rotation of the break-up roller.

The axial displaceability of the annular magnet 23 may of course also be achieved by other, known means.

The journal 24 on which the fiber guide disc 7 and the break-up roller 2 are supported, through the intermediary of bearings 8 and 15, respectively, is designed as a stationary thread extraction tube through which the finished yarn is withdrawn from the spinning turbine, for example by means of a pair of yarn extraction rollers.

Figure 5:
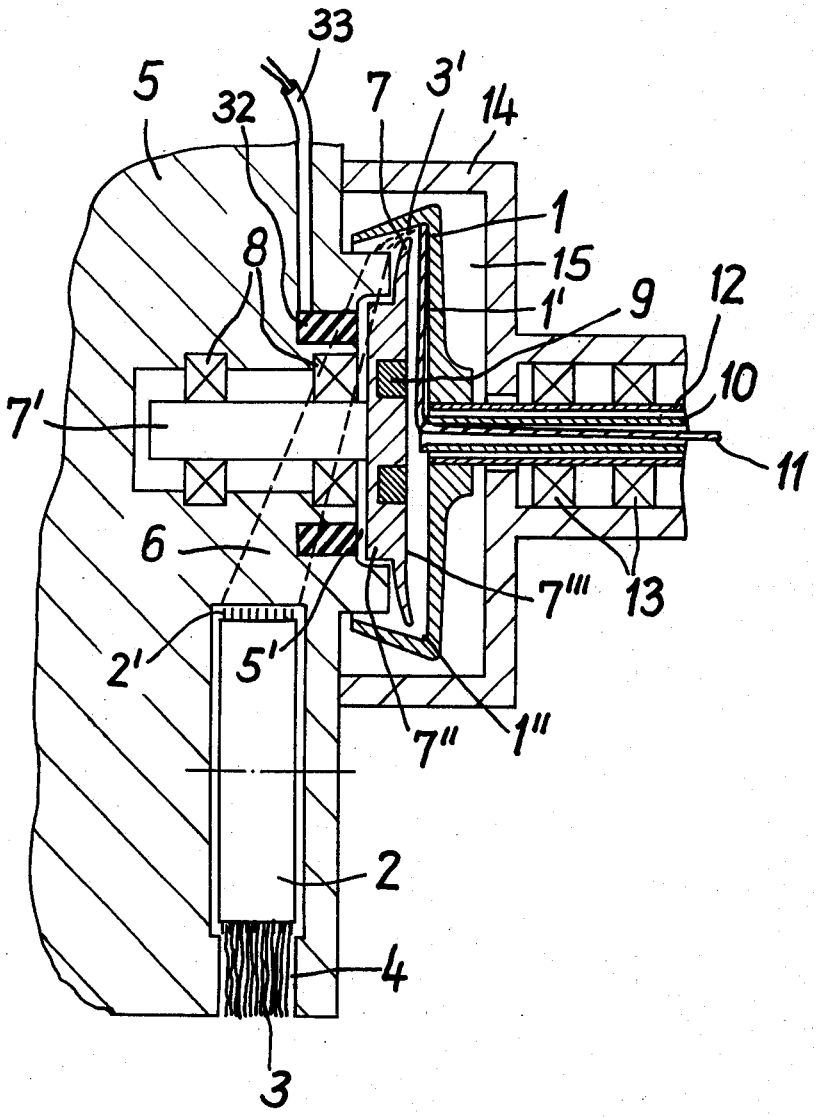
FIG. 5 is a view similar to that of FIG. 1 of an open-end spinning unit, but with an additional stationary electromagnet arranged to produce a variable field intensity.

The open-end spinning unit of FIG. 5 is similar to that of FIG. 1, but shows in addition a stationary electromagnet 32 which is inserted in housing 5 opposite and coaxial to fiber guide disc 7. Its magnetic force is variable by varying the supply of electrical energy via the wires 33. The part 7'' of the fiber guide disc opposite to electromagnet 32 consists of electrically conductive material.

The driving force acting between magnet 9 and spinning rotor 1 can be counteracted by the above described additional electromagnet 32 of variable field intensity to produce a variable driving force and in consequence an adjustable rotational speed of the fiber guide disc.

Figure 6:
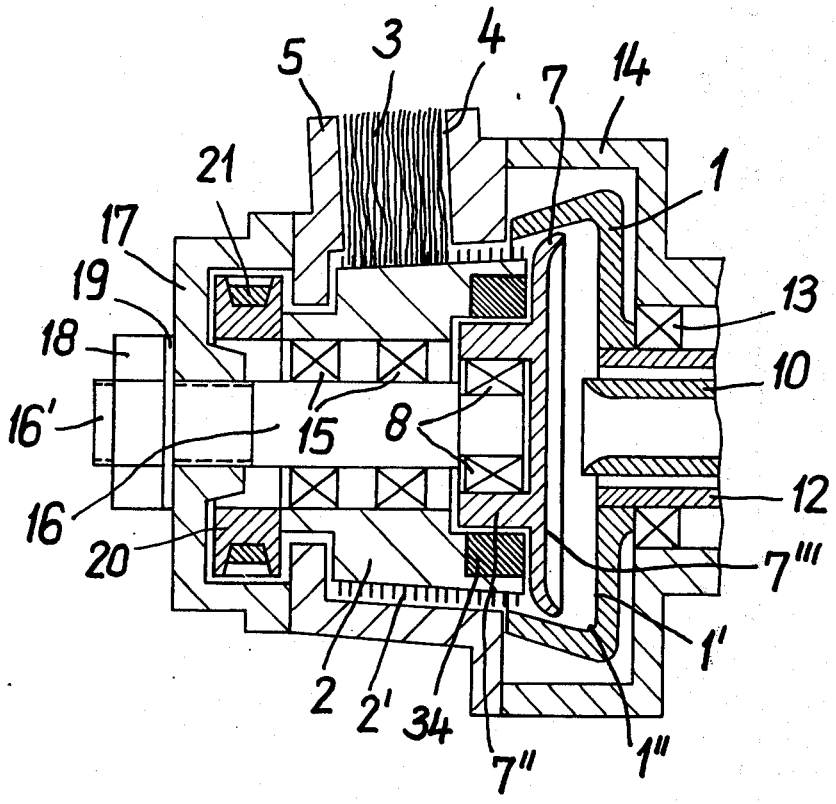
FIG. 6 is a view similar to that of FIG. 2 of an open-end spinning unit, but with a magnet arranged in the break-up roller coaxially with the fiber guide disc, and without vanes on the rotor side of the fiber guide disc, so that the disc is driven by magnetic forces from the break-up roller.

FIG. 6 shows an open-end spinning unit similar to that of FIG. 2 but without vanes 22. In addition an axially or radially polarised permanent magnet 34 is inserted into the break-up roller 2 opposite and coaxial to the fiber guide disc 7, which consists of electrically conductive material.

The break-up roller 2 is mechanically driven by a belt 21 as described in FIG. 2. The fiber guide disc 7 is driven by the magnetic forces acting between magnet 34 and the material of fiber guide disc 7, which is radially disposed opposite magnet 34, if magnet is radially polarised, which is axially disposed opposite magnet 34, if magnet is axially polarised.

It will be understood that the above description of the present invention is susceptible to various modifications, changes and adaptations, and the same are intended to be comprehended within the meaning and range of equivalents of the appended claims.

What is claimed is:

1. In an open-end spinning unit for producing yarn from fiber material, the unit including a spinning rotor member having a circumferential portion extending axially from one axial end face of the rotor to enclose a space in which such yarn is formed and which defines a fiber collection trough, and a fiber guide disc member rotatably mounted coaxially of the rotor member and having at least a portion disposed within such space, the improvement wherein said guide disc member is free of physical connection to any drive system and is mounted to be freely rotatable, and said unit comprises means establishing a force transmission between said rotor member and said disc member for causing the rotation of said rotor member to induce rotation of said disc member without physical contact between said rotor member and said disc member.

2. An arrangement as defined in claim 1 wherein said means establish a variable force transmission.

3. An arrangement as defined in claim 2 wherein one of said members is mounted for permitting the space between said facing axial end faces to be adjusted.

4. An arrangement as defined in claim 1 wherein said means comprise fluid coupling vanes on said fiber guide disc member disposed to be impelled by the circulation of air produced by rotation of said rotor member.

5. An arrangement as defined in claim 1 wherein said disc member has an axial end face facing, and spaced from, said one axial end face of said rotor member and said means comprise a multipole axially polarized annular magnet in one of said members adjacent its said axial end face and a region of electrically conductive material forming part of the other said member at a location opposite said annular magnet.

6. An arrangement as defined in claim 1 further comprising: a further member disposed at the other side of said disc member from said rotor member; and a second multipole axially polarized magnet carried by said further member at the face thereof facing said disc member; and wherein said disc is made of electrically conductive material at least at a location opposite said second magnet.

7. An arrangement as defined in claim 6 wherein said second magnet is at least radially stationary and is an electromagnet arranged to produce a variable field intensity.

8. An arrangement as defined in claim 6 wherein said further member is a break-up roller mounted coaxially with said fiber guide disc member.

9. An arrangement as defined in claim 6 wherein one of said further member and second magnet is mounted for permitting the space between them to be adjusted.

10. In an open-end spinning unit for producing yarn from fiber material, the unit including a spinning rotor member having a circumferential portion extending axially from one axial end face of the rotor to enclose a space in which such yarn is formed and which defines a fiber collection trough, a fiber guide disc member rotatably mounted coaxially of the rotor member and having at least a portion disposed within such space, and a further member disposed adjacent the disc member, the improvement wherein said guide disc member is free of physical connection to any drive system and is mounted to be freely rotatable, and said unit comprises means establishing a force transmission between said further member and said disc member for causing rotation of said disc member without physical contact between said further member and said disc member.

* * * * *